United States Patent [19]

Osterried

[11] 4,094,649

[45] June 13, 1978

[54] BRIQUETTE IGNITING DEVICE WITH FORAMINOUS METAL CONE

[76] Inventor: Gordon A. Osterried, Box 65, Kelowna, British Columbia, Canada

[21] Appl. No.: 772,498

[22] Filed: Feb. 28, 1977

[51] Int. Cl.[2] ..... C10L 11/08; C10L 11/00; A47J 37/00

[52] U.S. Cl. ..... 44/35; 44/38; 126/25 B

[58] Field of Search ..... 44/35, 34, 38; 126/25 B

[56] References Cited

U.S. PATENT DOCUMENTS

| | | | |
|---|---|---|---|
| 44,262 | 9/1864 | Thayer | 44/34 |
| 2,939,773 | 6/1960 | Rymer | 44/35 |

*Primary Examiner*—Carl F. Dees
*Attorney, Agent, or Firm*—Harris, Kern, Wallen & Tinsley

[57] ABSTRACT

A briquette igniting device including: an open-top container having a bottom wall and an upstanding peripheral wall with air inlet openings in the peripheral wall adjacent the bottom wall, the latter having a central depression to receive a liquid fuel, and the peripheral wall having an enlarged access opening therein adjacent the bottom wall; and a central, frusto-conical, foraminous member seated on the bottom wall and extending upwardly therefrom and spaced inwardly from the peripheral wall, the foraminous member having at the lower end thereof a tubular portion extending laterally to and communicating with the access opening in the peripheral wall.

2 Claims, 4 Drawing Figures

BRIQUETTE IGNITING DEVICE WITH FORAMINOUS METAL CONE

BACKGROUND OF INVENTION

The present invention relates in general to a briquette igniting device and, more particularly, to one which includes an open-top container for the reception of briquettes to be ignited therein by an igniting means within the container. With this construction, the briquettes, after ignition, can readily be dumped from the container onto or into a receptacle where they are to be used for barbecuing, or other purposes.

Relevant prior art known to me includes the following, all U.S. Patents except the last: U.S. Pat. No. 2,939,773 to Rymer; U.S. Pat. No. 3,062,200 to Miller; U.S. Pat. No. 3,112,716 to Knight; U.S. Pat. No. 3,117,826 to Cohen; U.S. Pat. No. 3,216,379 to Durfee; U.S. Pat. No. 3,296,984 to Durfee; U.S. Pat. No. 3,339,505 to Bean; U.S. Pat. No. 3,734,034 to Fowler; U.S. Pat. No. 3,739,732 to Graham; U.S. Pat. No. 3,814,035 to Miller; U.S. Pat. No. 3,841,299 to Tomita; U.S. Pat. No. 3,865,052 to Streets et al; U.S. Pat. No. 3,934,520 to Brennan et al; British Patent No. 17,067.

SUMMARY AND OBJECTS OF INVENTION

With the foregoing background in mind, a general object of the present invention is to provide a briquette igniting device incorporating various improvements on prior devices of this type.

More particularly, the invention may be summarized as including, and a primary object of the invention is to provide a briquette igniting device which includes: an open-top container having a bottom wall and an upstanding peripheral wall with air inlet openings in the peripheral wall adjacent the bottom wall, and with an enlarged access opening in the peripheral wall adjacent the bottom wall; a handle connected to the container; and a central, frusto-conical, foraminous member seated on the bottom wall and extending upwardly therefrom and spaced inwardly from the peripheral wall, the foraminous member having at the lower end thereof a tubular portion extending laterally to and communicating with the access opening. A related object is to provide the bottom wall with a central depression to receive a liquid fuel.

With the foregoing construction, the space between the foraminous member and the bottom and peripheral walls of the container is filled with briquettes to be ignited by burning liquid fuel in the central depression in the bottom wall, such liquid fuel being ignited through the access opening and the laterally-extending tubular portion of the foraminous member. If desired, ignition of the briquettes may be accelerated by pouring additional liquid fuel thereover from the open top of the container.

DESCRIPTION OF EXEMPLARY EMBODIMENT OF INVENTION

Figure 1:
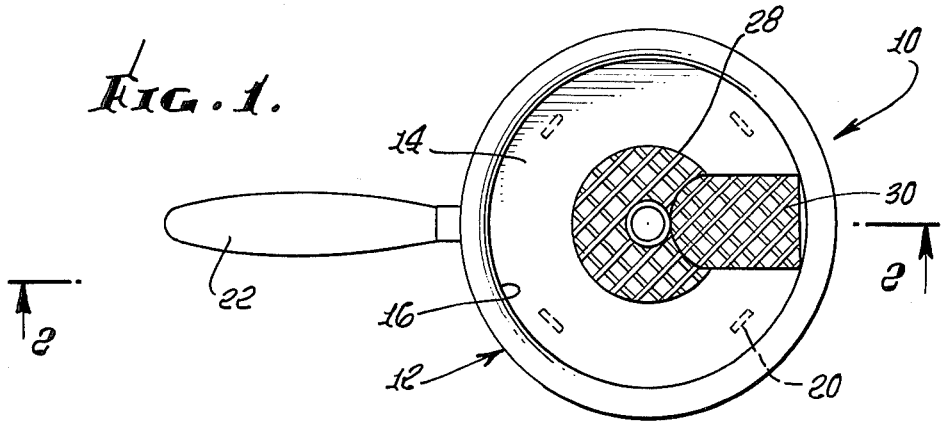
FIG. 1 is a plan view of a briquette igniting device which embodies the invention.
Figure 2:
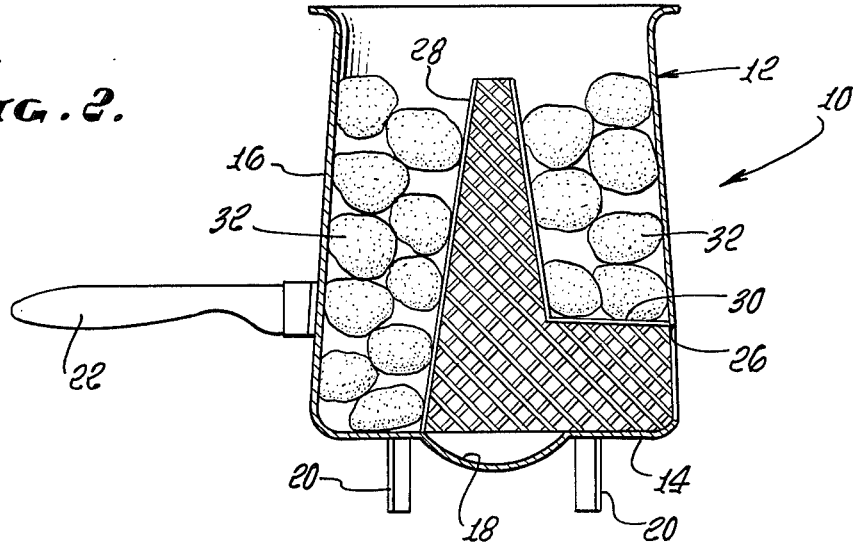
FIG. 2 is a vertical sectional view taken as indicated by the arrowed line 2—2 of FIG. 1.
Figure 4:
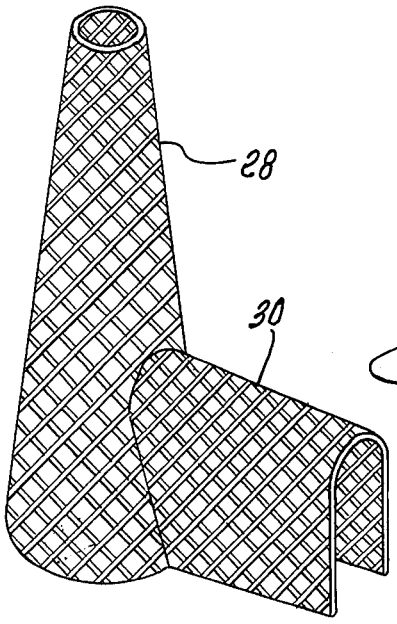
FIG. 4 is a perspective view of a foraminous member to be positioned within a container of the device.
Figure 3:
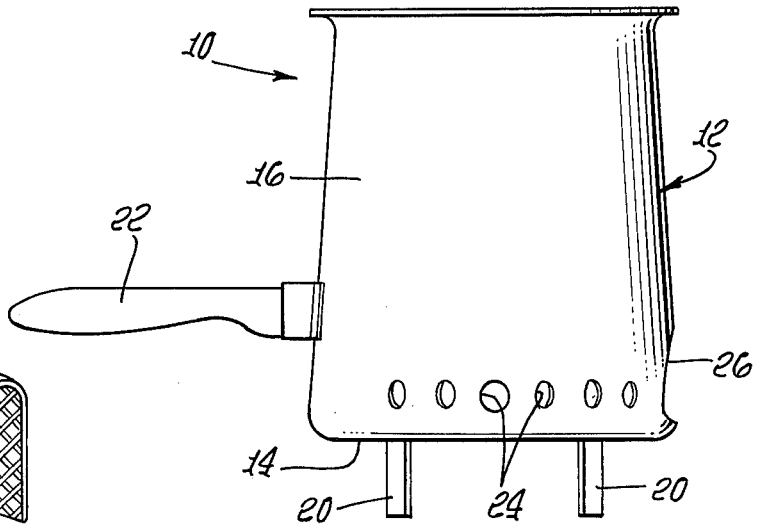
FIG. 3 is a side elevational view of the briquette igniting device.

Referring to the drawing, the numeral 10 designates generally the briquette igniting device of the invention. The igniting device 10 includes an open-top container 12 of generally cylindrical configuration, the container having a bottom wall 14 and a peripheral wall 16 which is shown as converging upwardly somewhat. The bottom wall 14 has a central depression 18 to receive a liquid fuel, as will be described.

The bottom wall 14 carries legs 20 which space the bottom wall 14 upwardly from a supporting surface, not shown, on which the device 10 is placed. A handle 22 is connected to the peripheral wall 16 of the container 12 adjacent and above the bottom wall 14 thereof.

The peripheral wall 16 of the container 12 is provided adjacent, and spaced upwardly from, the bottom wall 14 with circumferentially spaced air inlet openings 24. The peripheral wall 16 is also provided, above and adjacent the bottom wall 14 and opposite the handle 22, with an enlarged access opening 26.

A central, frusto-conical, foraminous member 28 is seated on and suitably secured to the bottom wall 14 and extends upwardly therefrom, the member 28 being spaced inwardly from the peripheral wall 16. The foraminous member 28, which may be made of expanded metal, is provided at the lower end thereof with a tubular portion 30 extending laterally to and communicating with the access opening 26. The purpose of the access opening 26 and the tubular portion 30 is to permit the ignition of liquid fuel in the central depression 18 (and/or liquid fuel saturating briquettes 32 within the container 12 around the foraminous member 28).

In use, liquid fuel is placed in the central depression 18, or is applied to the briquettes 32, or both. The fuel is then ignited through the access opening 26 and the tubular portion 30 of the foraminous member 28. The briquettes 32 are quickly ignited and, after ignition, can readily be dumped from the container 12 onto or into a receptacle where they are to be used for barbecuing, or other purposes.

Although an exemplary embodiment of the invention has been illustrated herein for purposes of illustration, it will be understood that various changes, modifications and substitutions may be incorporated in such embodiment without departing from the invention as hereinafter claimed.

I claim as my invention:

1. In a briquette igniting device, the combination of:

(a) an open-top container having a bottom wall and an upstanding peripheral wall;

(b) a handle connected to said container;

(c) said peripheral wall having air inlet openings therein adjacent said bottom wall;

(d) said peripheral wall having an enlarged access opening therein adjacent said bottom wall;

(e) a central, frusto-conical, foraminous member seated on said bottom wall and extending upwardly therefrom and spaced inwardly from said peripheral wall; and (f) said foraminous member having at the lower end thereof a tubular portion extending laterally to and communicating with said access opening.

2. A briquette igniting device as defined in claim 1 wherein said bottom wall is provided with a central depression to receive a liquid fuel.

* * * * *